US011730660B1

(12) United States Patent
Agbi

(10) Patent No.: US 11,730,660 B1
(45) Date of Patent: Aug. 22, 2023

(54) THERAPEUTIC APPARATUS FOR SUPPORTING A LIMB AND FACILITATING COMPRESSION OF THE LIMB

(71) Applicant: John Agbi, Wellington, FL (US)

(72) Inventor: John Agbi, Wellington, FL (US)

( * ) Notice: Subject to any disclaimer, the term of this patent is extended or adjusted under 35 U.S.C. 154(b) by 564 days.

(21) Appl. No.: 16/506,517

(22) Filed: Jul. 9, 2019

(51) Int. Cl.
*A61H 23/00* (2006.01)
*A61H 9/00* (2006.01)

(52) U.S. Cl.
CPC ..... *A61H 9/005* (2013.01); *A61H 9/0007* (2013.01); *A61H 23/00* (2013.01); *A61H 2201/5007* (2013.01); *A61H 2205/106* (2013.01); *A61H 2209/00* (2013.01)

(58) Field of Classification Search
CPC ..... A61H 9/005; A61H 9/0007; A61H 2201/5007; A61H 2205/106; A61H 2209/00; A61H 7/007; A61H 9/0078; A61H 9/0092; A61H 2007/009; A61H 15/00; A61H 2201/164; A61H 2201/1645; A61H 2205/10; A61H 2205/12; A61H 2205/125
See application file for complete search history.

(56) References Cited

U.S. PATENT DOCUMENTS 4,071,031 A 1/1978 Lowman
4,989,584 A 2/1991 Simon
5,046,487 A 9/1991 Scott
6,796,928 B1* 9/2004 Christopher et al. ..... A63B 22/0056 482/123
2006/0155221 A1* 7/2006 Kim ..... A61H 1/005 601/29
2013/0041298 A1* 2/2013 Mayer et al. ..... A61H 23/02 601/29

FOREIGN PATENT DOCUMENTS

CN 107693278 A * 2/2018
CN 107822850 A * 3/2018 ..... A61H 15/0078

OTHER PUBLICATIONS

English Translation For CN-107693278-A (Year: 2018).*

* cited by examiner

*Primary Examiner* — Quang D Thanh
(74) *Attorney, Agent, or Firm* — SANCHELIMA & ASSOCIATES, P.A.; Christian Sanchelima; Jesus Sanchelima

(57) ABSTRACT

A therapeutic apparatus for supporting a limb and compressing the limb. The therapeutic apparatus includes a housing, and a plurality of telescopic support bars mounted underneath of the housing. The therapeutic apparatus includes a plurality of pads, a pad is mounted to one the telescopic support bars. The therapeutic apparatus includes a plurality of pressure actuators provided at each of the pads. The therapeutic apparatus further includes a motor electrically coupled to the telescopic support bars, the pads and the pressure actuators. A limb is received at an opening of the pad, and the motor is operated to adjust the height of the telescopic support bars and to adjust the angle of the pads. The motor is further operated to engage the pressure actuators to compress and to apply heat or cool to the limb to prevent blood clots and swelling and pain at the limb or calf.

5 Claims, 6 Drawing Sheets

THERAPEUTIC APPARATUS FOR SUPPORTING A LIMB AND FACILITATING COMPRESSION OF THE LIMB

II. BACKGROUND OF THE INVENTION

1. Field of the Invention

The present disclosure generally relates to therapeutic apparatuses. More specifically, the present disclosure relates to a therapeutic apparatus for providing compression and thermal therapy for a limb and other body parts.

2. Description of the Related Art

Generally, a healthy muscle, for example, a leg muscle squeezes the deep veins of the legs and feet to help move blood back to the heart. As known, one-way valves in the deep leg veins keep blood flowing back to the heart. However, standing or sitting for long periods may cause the walls of the deep leg veins to stretch. Over time, this may weaken the vein walls and damage the valves, causing blood to pool in the veins and increase venous blood pressure.

In order to address the issue, therapeutic intermittent compression of the limbs is used for the enhancement of blood circulation. Several devices have been proposed in the past that helps to prevent deep vein thrombosis ("DVT") after surgeries, others were developed and used for the treatment of arterial related problems such as peripheral vascular disease and diabetic ulcers. In one example, compression bandages are used to apply pressure to the leg. The compression bandages work in a way that a bandage is applied with constant tension so as to produce graduated compression with the highest pressure at the ankle.

Although the devices that are available are helpful in providing therapeutic intermittent compression for the limb, they pose several problems to a patient or user. For instance, height of the device is not adjustable. As a result, the user may have to position the limb in an unconformable position, which may lead to swelling and also increase the pain for the user.

In order to overcome the above problems, several support devices have been proposed in the past that allows the user to rest or support his limb. One such example is disclosed in a U.S. Granted Pat. 4071031. In US4071031A, it is disclosed that the invention comprises a limb support having upper, middle and lower sections. The upper section includes two compartments for receiving a fluid or ice and forming a trough to receive a limb of the patient. The middle section is in the form of an inflatable compartment for adjusting the height of the unit. The lower section includes three triangular-shaped compartments for adjusting the angle at which the unit is to be rested.

Another example is disclosed in a U.S. Granted Pat. 4989584. In US4989584A, it is disclosed that a portable massaging leg rest comprises a generally polygonal body of resilient foam having a top face and a front face sloping away from the top face with a sharp angle between the top and sloping faces. The upper portion of the body is formed of a cushioning resilient foam which is softer than foam in the lower portion of the body. An eccentric motor is mounted on a rigid plate within the body for causing massaging motion in at least the top poriton of the body. A channel extends through the body to the motor through which air can circulate for cooling the motor.

Another example is disclosed in a U.S. Granted Pat. 5046487. In US5046487A, it is disclosed that a therapeutic leg elevator for promoting venous flow during patient recuperation including a substantially homogeneous solid polygonal shaped member having at least one inclined surface for supporting a back portion of a patient's thigh and second inclined surface with respect to the first for supporting the patient's lower leg, a member is releasably connected to a distal end of the homogeneous support member to provide resistance exercise for the patient.

Although the therapeutic leg elevators discussed above are capable in supporting the limb while performing therapeutic intermittent compression, they have few problems. For instance, the construction of the therapeutic leg elevators is complex and requires another person to operate the therapeutic leg elevators to position the limb at desired height so as to avoid or minimize pain for the patient. Further, elderly people may find it difficult to use the therapeutic leg elevators as they use complex mechanism to adjust the height.

Other documents describing the closest subject matter provide for a number of more or less complicated features that fail to solve the problem in an efficient and economical way. None of these patents suggest the novel features of the present invention. Specifically, none of the disclosures in the art disclose a therapeutic apparatus comprising a mechanism to support a limb to position at desired height, and provide compression and thermal therapy for the limb.

Therefore, there is a need to provide a therapeutic apparatus comprising a mechanism to support a limb to position at desired height, and to provide compression and thermal therapy for the limb.

III. SUMMARY OF THE INVENTION

It is one of the objects of the present invention to provide a therapeutic apparatus comprising a mechanism to support a limb to position at desired height and that avoids the drawbacks of the prior art.

It is another object of the present invention to provide a therapeutic apparatus capable of providing compression while allowing a patient to position the limb at desired height.

It is still another object of the present invention to provide a therapeutic apparatus capable of providing compression to prevent blood clots.

It is one object of the present invention to provide a therapeutic apparatus that allows to place the calf on a pad, and to position the leg for compressing the calf at desired height so as to prevent swelling and reduce pain for a user or patient.

It is one object of the present invention to provide a therapeutic apparatus that allows applying thermal therapy for the user.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a therapeutic apparatus for supporting a limb and compressing the limb. The therapeutic apparatus comprises a housing, and a plurality of telescopic support bars mounted at a bottom of the housing. The therapeutic apparatus comprises a plurality of pads in which a pad of the plurality of pads is mounted to a telescopic support bar of the plurality of telescopic support bars. The therapeutic apparatus comprises a plurality of pressure actuators provided at each of the plurality of pads. The therapeutic apparatus further comprises a motor electrically coupled to the plurality of telescopic support bars, the plurality of pads and the plurality of pressure actuators. A limb is received at an opening of the pad, and the motor is operated to adjust height of the plurality of telescopic support bars, and adjust angle of the pads. The motor is further operated to engage the plurality of pressure actuators to compress and to apply heat or cool to the limb to prevent blood clots and swelling and pain at the limb or calf.

Various features and embodiments of a therapeutic apparatus for supporting a limb and compressing the limb are explained in conjunction with the description of FIGS. 1-6.

Figure 1:
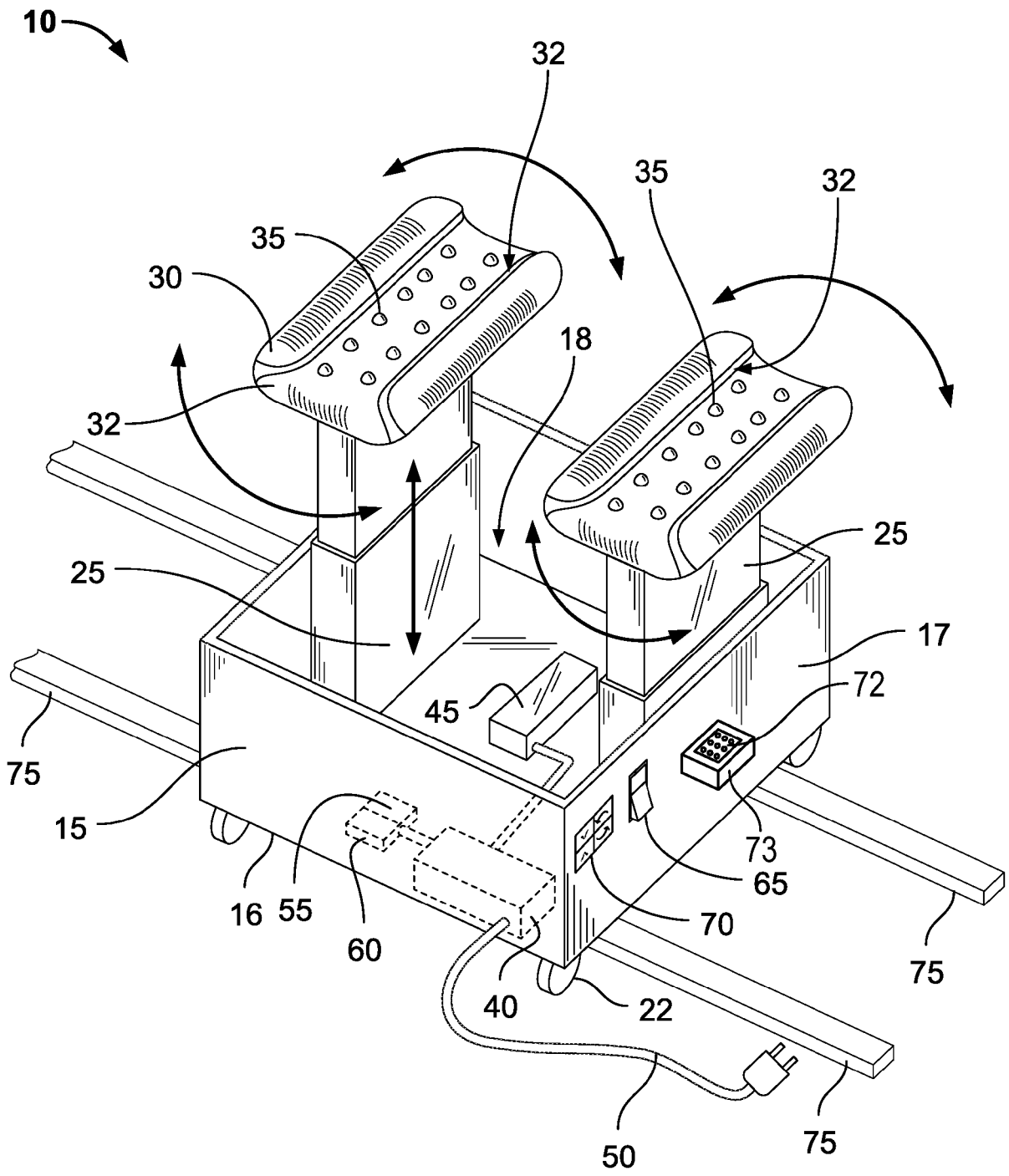
FIG. 1 illustrates a perspective view of a therapeutic apparatus 10, in accordance with one embodiment of the present disclosure.
Figure 2:
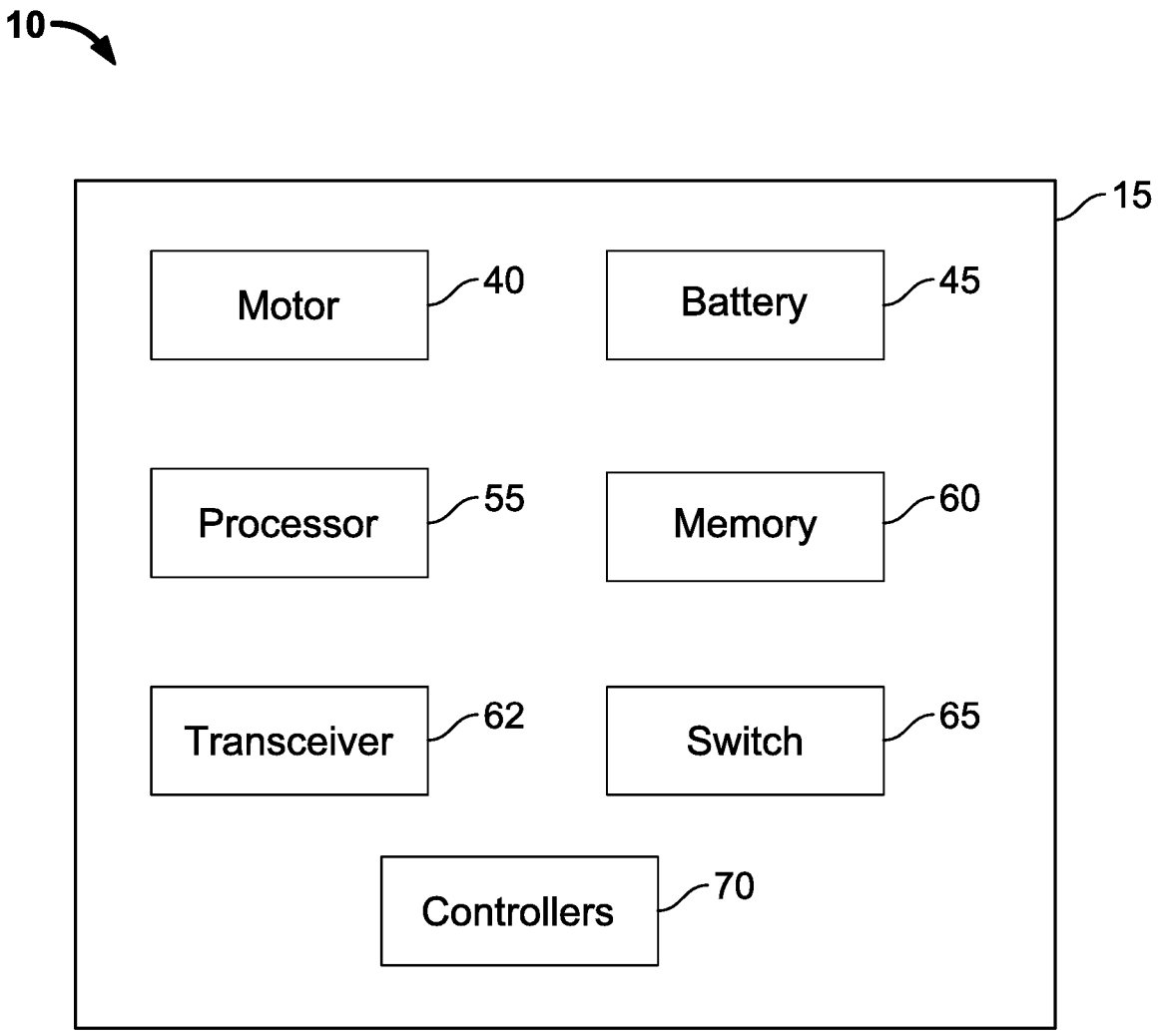
FIG. 2 illustrate a block diagram of a therapeutic apparatus 10, in accordance with one embodiment of the present disclosure.

Referring to FIGS. 1 and 2, a perspective view and a block diagram, respectively of a therapeutic apparatus 10 are shown, in accordance with one embodiment of the present disclosure. The therapeutic apparatus 10 comprises a housing 15. The housing 15 comprises a bottom 16, upstanding sidewalls 17 and an open top 18. It should be understood that the bottom 16, the upstanding sidewalls 17 and the open top 18 form a container with open top. It should be understood that the housing 15 might be made up of metal, plastic, wood or any other material. In one example, the therapeutic apparatus 10 might be provided with wheels 22 underneath the housing 15. It should be understood that the wheels 22 help maneuvering the therapeutic apparatus 10 from one place to another. In one example, each of the wheels 22 might be provided with be a wheel restricting arm for restricting movement of the wheel 22 so as to lock wheels 22 from moving and to stay firmly at a place.

In one implementation, the therapeutic apparatus 10 comprises a plurality of telescopic support bars 25. The plurality of telescopic support bars 25 might be provided at the bottom 16 of the housing 15 facing the open top 18. The plurality of telescopic support bars 25 might be made up of metal, plastic or any other suitable material. The plurality of telescopic support bars 25 are selected such that they have capability to withstand weight of the user and withstand vibrations caused by the therapeutic apparatus 10 during its operation. It should be understood that height of the plurality of telescopic support bars 25 might be adjusted by operating a male and female support bars in that the support bars 25 are extended or contracted to adjust the length of the plurality of telescopic support bars 25. In other words, the plurality of telescopic support bars 25 is configured to contract to reduce the length and expanded to increase the length of the plurality of telescopic support bars 25. In the current implementation, the plurality of telescopic support bars 25 may include one telescopic support bar. Alternatively, the plurality of telescopic support bars 25 may include two or more telescopic support bars. Preferably, two telescopic support bars are provided as that a user can place both legs to relieve from pain and compress the limb to reduce blood clots. In an alternative embodiment, the bars may be fixed meaning they may not be telescopic.

Each of the plurality of telescopic support bars 25 is provided with a pad 30. It should be understood that each of the pads 30 is mounted to respective telescopic support bar 25 in that the pad 30 is tiltable or swingable about its own axis. It should be understood that each of the pads 30 is mounted to respective telescopic support bar 25 using known mechanisms, for example a hinge mechanism. Each of the pads 30 might be provided in oval shape in that walls of the pads 30 are inclined or bent towards its inner side. As can be seen, the pads 30 are inclined to provide an opening 32 at the top. In other words, the pads 30 are inclined and the opening 32 is provided to receive a limb of a patient or user. It should be understood that inner wall of each pad 30 might be made up of cushion material or cushion resilient material such as cushion resilient foam.

Further, each of the pads 30 is provided with a plurality of pressure actuators or massage rollers or pressure points 35. The plurality of pressure actuators 35 might be provided in different shapes and sizes. Further, the therapeutic apparatus 10 comprises a motor 40 provided at the bottom 16 of the housing 15. The plurality of pressure actuators 35 is electrically coupled to the motor 40. Further, the motor 40 is electrically coupled to the plurality of telescopic support bars 25 and the pads 30.

The therapeutic apparatus 10 further comprises a battery 45 electrically coupled to the motor 40. The battery 45 might be placed at the bottom 16 of the housing 15. The battery 45 may include a rechargeable battery, for example a Lithium-Ion battery. The battery 45 is used to power the components to operate the therapeutic apparatus 10. Further, the therapeutic apparatus 10 may comprise a cable 50 used to power the therapeutic apparatus 10 or to charge the battery 45. It should be obvious to a person skilled in the art that the cable 50 might be provided in a retractable manner in that the cable 15 is retrieved into the housing 15 when the therapeutic apparatus 10 is not in use and can be extended to mount the cable 15 a power source.

In one implementation, the therapeutic apparatus 10 may comprise a processor 55, a memory 60 and a transceiver 62, as shown in FIGS. 1 and 2. The processor 55 may be implemented as one or more microprocessors, microcomputers, controllers, digital signal processors, central processing units, state machines, logic circuitries, and/or any devices that manipulate signals based on operational instructions. Among other capabilities, the processor 55 is configured to fetch and execute computer-readable instructions or program instructions stored in the memory 60.

The memory 60 may include any computer-readable medium known in the art including, for example, volatile memory, such as static random access memory (SRAM) and dynamic random access memory (DRAM), and/or non-volatile memory, such as read only memory (ROM), erasable programmable ROM, flash memories, hard disks, and so on.

The transceiver 62 may indicate a circuitry capable of transmitting and receiving data from the therapeutic apparatus 10 to other devices. The transceiver 62 might be operated using variety of communication protocols such as Bluetooth, Wi-Fi, Cellular network, NFC, Infrared and other known communication protocols. It should be understood that the transceiver 62 allows a user to operate the therapeutic apparatus 10 remotely, for example using a remote controller or a mobile phone. In order to operate the therapeutic apparatus 10, the user may use the remote controller to send signals to the processor 55 via the transceiver 62. The processor 35 receives the signals and operates the motor 40 to operate the therapeutic apparatus 10.

Further, the therapeutic apparatus 10 may comprise a switch or an actuator 65 provided at outer surface of one of the upstanding sidewalls 17 of the housing 15. Optionally, the therapeutic apparatus 10 may be provided with controllers 70 which may include one or more buttons or toggles to control speed of the motor 40 and/or to adjust the height of the telescopic support bars 25, rotation of the pads 30 and also to control temperature of the pressure actuators 35. Alternatively, the therapeutic apparatus 10 might be provided with a remote controller 72. The remote controller 72 might be placed on a support plate 73 mounted to the housing 15. It should be understood that the position of the support plate 73 is shown for illustrative purpose only. A person skilled in the art will understand that the support plate 73 might be provided at other places on the housing 15 such that the user might be able to access the remote controller 72 to operate the therapeutic apparatus 10. In order to operate therapeutic apparatus 10, the remote controller 72 might be used to send instructions to the processor 55 via the transceiver 62. Alternatively, the therapeutic apparatus 10 might be communicatively mounted to an electronic device such as a mobile phone, laptop and so on. The electronic device might be communicatively mounted to the therapeutic apparatus 10 using one of Bluetooth, Wi-Fi, Cellular network and so on. The user may use the electronic device to send instructions to the processor 55 via the transceiver 62.

In one implementation, the therapeutic apparatus 10 might be provided with telescopic extendable arms 75. The telescopic extendable arms 75 might be made up of metal, hard plastic or any other suitable material. The telescopic extendable arms 75 are provided underneath the bottom 16 of the housing 15. It should be understood that the telescopic extendable arms 75 are provided to stabilize the housing 15 when the housing 15 is placed on uneven surfaces. For example, if the therapeutic apparatus 10 has to be used on an uneven surface such as a bed, then the housing 15 might be placed on the telescopic extendable arms 75. In an alternative embodiment the arms may be fixed instead of telescopic.

Figure 3:
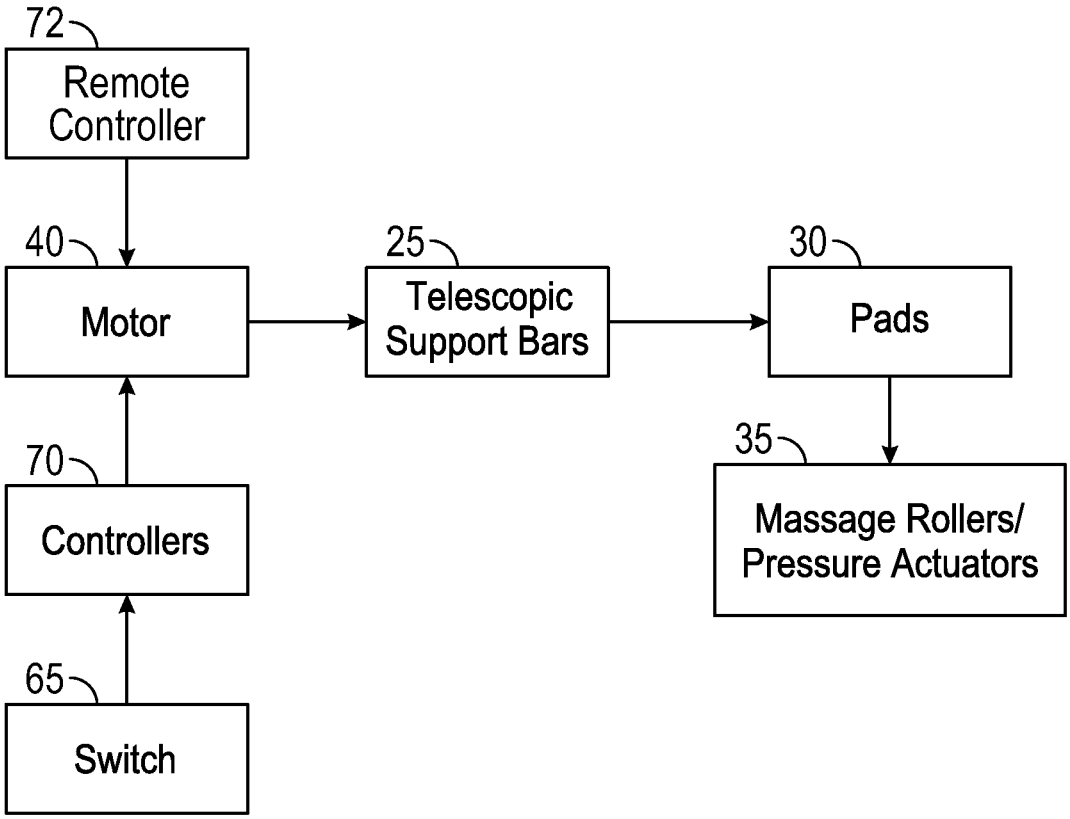
FIG. 3 illustrates operation of the therapeutic apparatus 10, in accordance with one embodiment of the present disclosure.

Now referring to FIG. 3, operation of the therapeutic apparatus 10 is explained, in accordance with one exemplary embodiment of the present disclosure. It should be understood that the therapeutic apparatus 10 might be used to compress calf of a user or patient to prevent blood clots. Further, the therapeutic apparatus 10 might be used to prevent swelling and reduce pain on the limb of the user. Further, the therapeutic apparatus 10 might be used to apply heat or cool on the limb of the user.

In order to operate to therapeutic apparatus 10 to compress calf, or to apply hear or cool on the limb, at first, a limb/leg of the user is placed at the pad 30 through the opening 32. Alternatively, if the user wishes to place both legs, then the user may place each leg in separate pads 30. Upon placing the legs in the pads 30, the user may turn ON the switch 65. Upon turning ON, the user may operate the controllers 70 to adjust height of one or both telescopic support bars 25. Subsequently, the user may operate the controllers 70 to adjust angle or tilt of the pads 30. After adjusting the position of the telescopic support bars 25 and angle of the pads 30, the user may operate the controllers 70 to control the speed of the motor 40 in order to engage the plurality of pressure actuators 35. In one exemplary embodiment, the user might operate the therapeutic apparatus 10 using the remote controller 72 or the electronic device such as a mobile phone. The user may use the remote controller 72 or the electronic device to adjust angle or tilt of the pads 30, and to control the speed of the motor 40 and so on. It should be understood that the user may control the speed of the plurality of pressure actuators 35 by setting the speed of the motor 40, which controls the operation of the plurality of pressure actuators 35. The plurality of pressure actuators 35 are operated to apply pressure on the limb to compress the calf in order to alleviate muscular fatigue and discomfort in the legs. Further, the plurality of pressure actuators 35 are operated to compress the calf underneath to prevent blood clots. Alternatively, the plurality of pressure actuators 35 may be configured to apply heat or cool on the calf. Further, the plurality of pressure actuators 35 might be configured to apply heat, vibration or compression on the calf of the user. Additionally, the plurality of pressure actuators 35 might be used to prevent pressure ulcers in elderly or bed-ridden patients or users.

In one example, the therapeutic apparatus 10 may be provided with a timer (not shown) to apply heat or cool on the calf for a predetermined time period e.g., 5 minutes. In order to operate the timer, the processor 55 might be configured to operate the motor 40 for the predetermined time period such that the plurality of pressure actuators 35 might apply heat or cool to the calf thereby providing thermal therapy for the limb.

As the plurality of telescopic support bars 25 can be used to adjust the height at which the user can compress the calf and/or apply heat or cool the limb, swelling and pain caused due to uncomfortable positioning of the limb is reduced or prevented. It should be understood that the therapeutic apparatus 10 allows the user to compress one or both limbs simultaneously. It should be understood that the mouth or size of the opening 32 at the pad 30 could be adjusted so that limbs of various sizes can be received for compressing the calf and/or applying heat or cool the limb.

In one example, the leg or foot of the user might be placed in the pad 30 such that the pressure actuators or massage rollers 35 might be used to massage foot of the user.

As the therapeutic apparatus 10 is provided with wheels 22 underneath the housing 15, the user may easily maneuver the therapeutic apparatus 10 from one place to another so as place at comfortable position to rest the leg and compress the limb.

Figure 4:
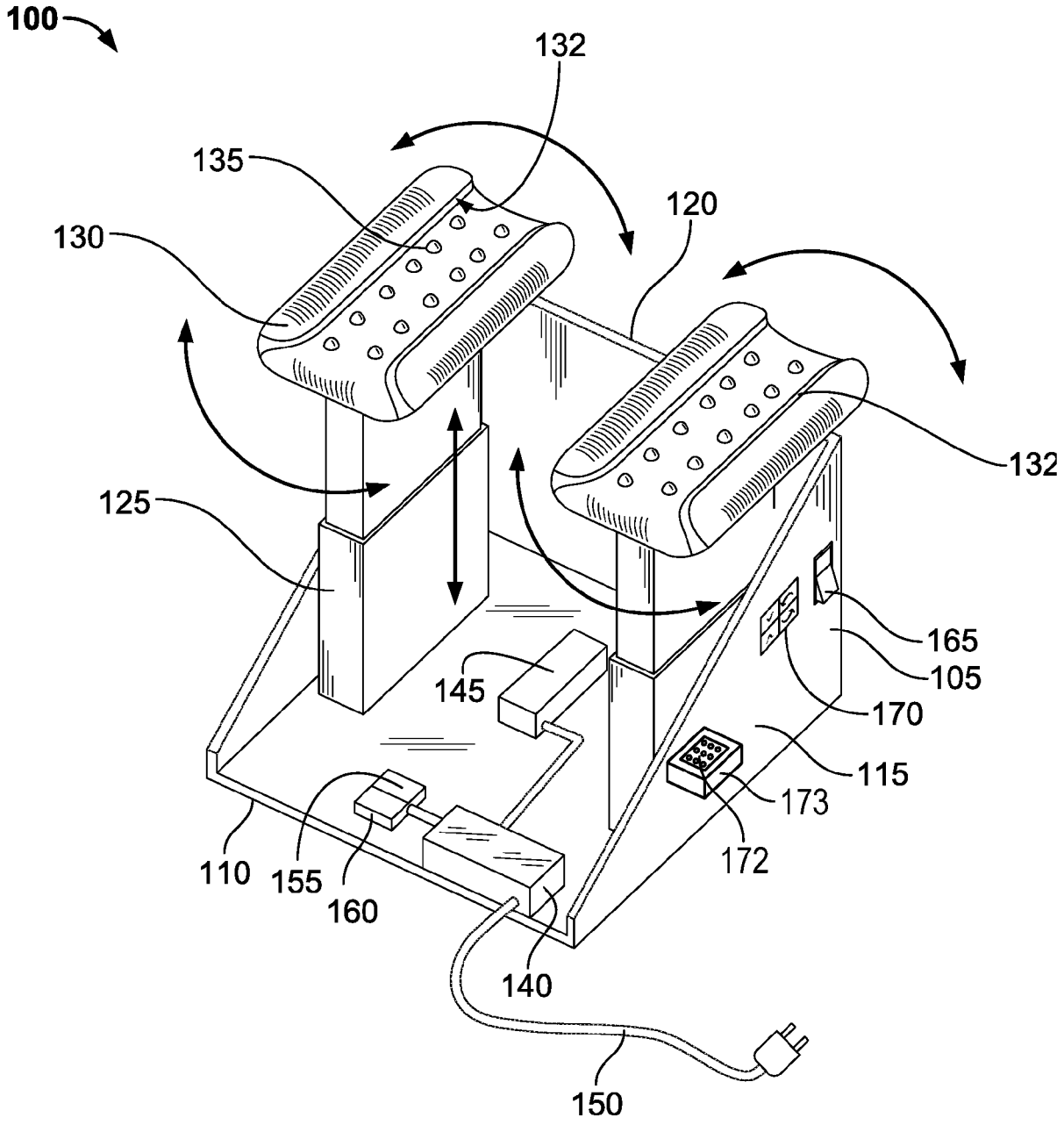
FIG. 4 illustrates a perspective view of a therapeutic apparatus 100, in accordance with another embodiment of the present disclosure.

Now referring to FIG. 4, a perspective view of a therapeutic apparatus 100 is shown, in accordance with another embodiment of the present disclosure. The therapeutic apparatus 100 comprises a housing 105. The housing 105 comprises a bottom 110, sidewalls 115 and a rear wall 120. In the current embodiment, the bottom 16 is provided in a relatively flat surface. As such, the housing 105 can be placed on flat surfaces such as floor. Further, the sidewalls 115 are provided in triangular shape. It should be understood that the housing 105 might be made up of metal, plastic, wood or any other material.

In one implementation, the therapeutic apparatus 100 comprises a plurality of telescopic support bars 125. The plurality of telescopic support bars 125 might be provided at the bottom 110 of the housing 105. The plurality of telescopic support bars 125 might be made up of metal, plastic or any other suitable material. It should be understood that height of the plurality of telescopic support bars 125 might be adjusted by operating a male and female support bars in that the support bars 125 are extended or contracted to adjust the length of the plurality of telescopic support bars 125. In other words, the plurality of telescopic support bars 125 is configured to contract to reduce the length and expanded to increase the length of the plurality of telescopic support bars 125.

Each of the plurality of telescopic support bars 125 is provided with a pad 130. It should be understood that each of the pads 130 is mounted to respective telescopic support bar 125 in that the pad 130 is tiltable or swingable about its own axis. It should be understood that each of the pads 130 is mounted to respective telescopic support bar 125 using known mechanisms, for example a hinge mechanism. Each of the pads 130 might be provided in oval shape in that walls of the pads 130 are inclined or bent towards its inner side. As can be seen, the pads 130 are inclined to form an opening 132. In other words, the pads 130 are inclined and the opening 132 is provided to receive a limb of a patient. It should be understood that inner wall of each pad 130 might be made up of cushion material or cushion resilient material.

Further, each of the pads 130 is provided with a plurality of pressure actuators or massage rollers or pressure points 135. The plurality of pressure actuators 135 might be provided in different shapes and sizes. Further, the therapeutic apparatus 10 comprises a motor 140 provided at the bottom 110 of the housing 105. The plurality of pressure actuators 135 is electrically coupled to the motor 140. Further, the motor 140 is electrically coupled to the plurality of telescopic support bars 125 and the pads 130.

The therapeutic apparatus 100 further comprises a battery 145 electrically coupled to the motor 140. The battery 145 might be placed at the bottom 110 of the housing 105. The battery 145 may include a rechargeable battery, for example a Lithium-Ion battery. The battery 145 is used to power the components to operate the therapeutic apparatus 100. Further, the therapeutic apparatus 100 may comprise a cable 150 used to power the therapeutic apparatus 100 or to charge the battery 145.

In one implementation, the therapeutic apparatus 100 may comprise a processor 155 and a memory 160 (similar to the processor 55 and the memory 60 shown in FIG. 1).

Further, the therapeutic apparatus 100 may comprise a switch or an actuator 165 provided at outer surface of one of the sidewalls 115 of the housing 105. Optionally, the therapeutic apparatus 100 may be provided with controllers 170 which may include one or more buttons or toggles to control speed of the motor 140 and/or to adjust the height of the telescopic support bars 125, rotation of the pads 130 and also to control temperature of the pressure points 135. Alternatively, the therapeutic apparatus 100 might be provided with a remote controller 172. The remote controller 172 might be placed on a support plate 173 mounted to the housing 105. It should be understood that the position of the support plate 173 is shown for illustrative purpose only. A person skilled in the art will understand that the support plate 173 might be provided at other places on the housing 105 such that the user might be able to access the remote controller 172 to operate the therapeutic apparatus 100.

Figure 5:
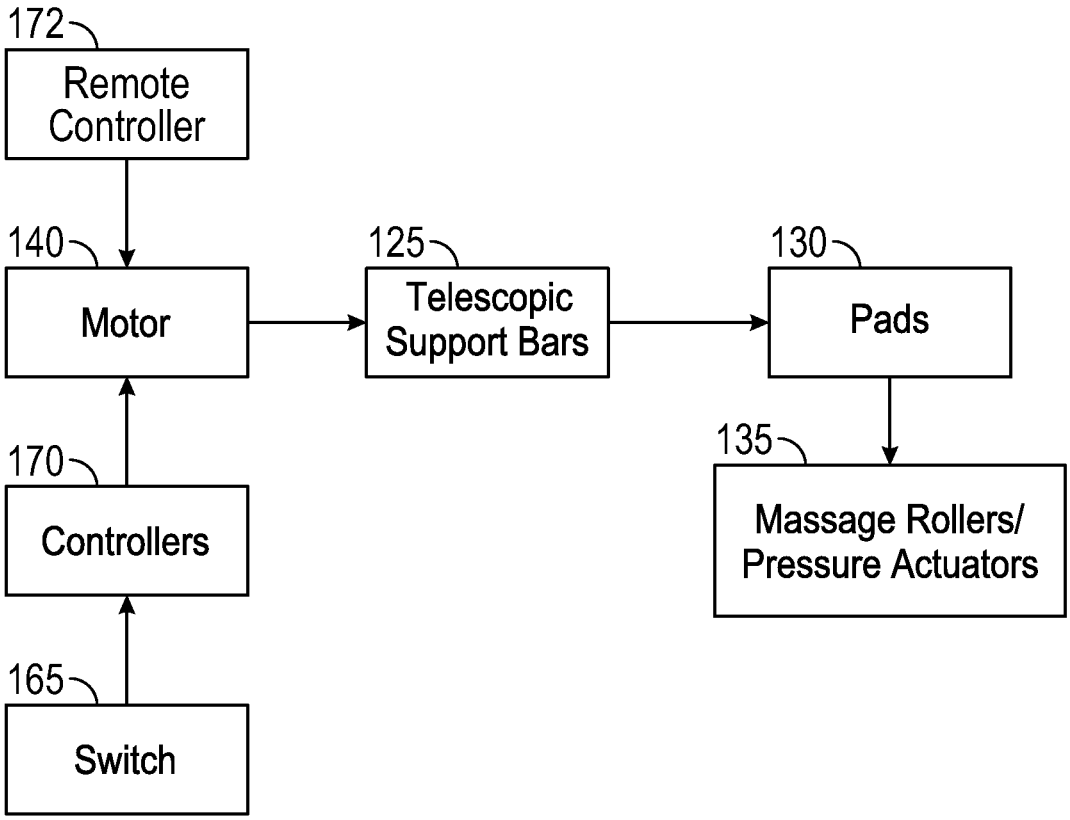
FIG. 5 illustrates operation of the therapeutic apparatus 100, in accordance with one embodiment of the present disclosure.

Now referring to FIG. 5, operation of the therapeutic apparatus 100 is explained, in accordance with one exemplary embodiment of the present disclosure. It should be understood that the therapeutic apparatus 100 might be used to compress calf of a user or patient to prevent blood clots. Further, the therapeutic apparatus 100 might be used to prevent swelling and reduce pain on the limb of the user. Further, the therapeutic apparatus 100 might be used to apply heat or cool on the limb of the user.

In order to operate to therapeutic apparatus 100 to compress calf, or to apply hear or cool on the limb, at first, a limb of is placed at the pad 130 through the opening 132. Alternatively, if the user wishes to place both legs, then the user may place each leg in separate pads 130. Upon placing the legs in the pads 130, the user may turn ON the therapeutic apparatus 100 using the switch 165. Upon turning ON the therapeutic apparatus 100, the user may operate the controllers 170 to adjust height of one or both telescopic support bars 125. It should be understood that the telescopic support bars 125 are used to adjust the height of the legs.

Subsequently, the user may operate the controllers 170 to adjust angle or tilt of the pads 130. After adjusting the position of the telescopic support bars 125 and angle of the pads 130, the user may operate the controllers 170 to control the speed of the motor 140 in order to engage the plurality of pressure actuators 135. It should be understood that the user may control the speed of the plurality of pressure actuators 135 by controlling the speed of the motor 140, which controls the operation of the plurality of pressure actuators 135. The plurality of pressure actuators 135 are operated to apply pressure on the limb to compress the calf in order to alleviate muscular fatigue and discomfort in the legs. Further, the plurality of pressure actuators 135 are operated to compress the calf underneath to prevent blood clots. Alternatively, the plurality of pressure actuators 135 may be configured to apply heat or cool on the calf. Although it is explained that the controllers 170 are used to operate the therapeutic apparatus 100, it should be obvious to a person skilled in the art to use the remote controller 172 as well to operate the therapeutic apparatus 100 to compress the calf.

In one example, the therapeutic apparatus 100 may be provided with a timer to apply heat or cool on the calf for a predetermined time period e.g., 5 or 10 minutes. In order to operate the timer, the processor 155 might be configured to operate the motor 140 for a predetermined time period such that the plurality of pressure actuators 135 might apply heat or cool to the calf thereby providing thermal therapy for the limb. Additionally, the plurality of pressure actuators 135 might be used to prevent pressure ulcers in elderly or bed-ridden patients or users.

As the plurality of telescopic support bars 125 can be used to adjust the height at which the user can compress the calf and/or apply heat or cool the limb, swelling and pain caused due to uncomfortable positioning of the limb is reduced or prevented. It should be understood that the therapeutic apparatus 100 allows the user to compress one or both limbs simultaneously.

It should be understood that the therapeutic apparatus 100 is provided to illustrate different shape of the housing 105 that can be used to place the plurality of telescopic support bars 125 and the pads 130. However, this should not be construed in limited sense as other shapes and sizes of the plurality of telescopic support bars 125 and the pads 130 may also be used to compress the limb and/or to control temperature i.e., heat or cool the limb using the pressure actuators 135.

Figure 6:
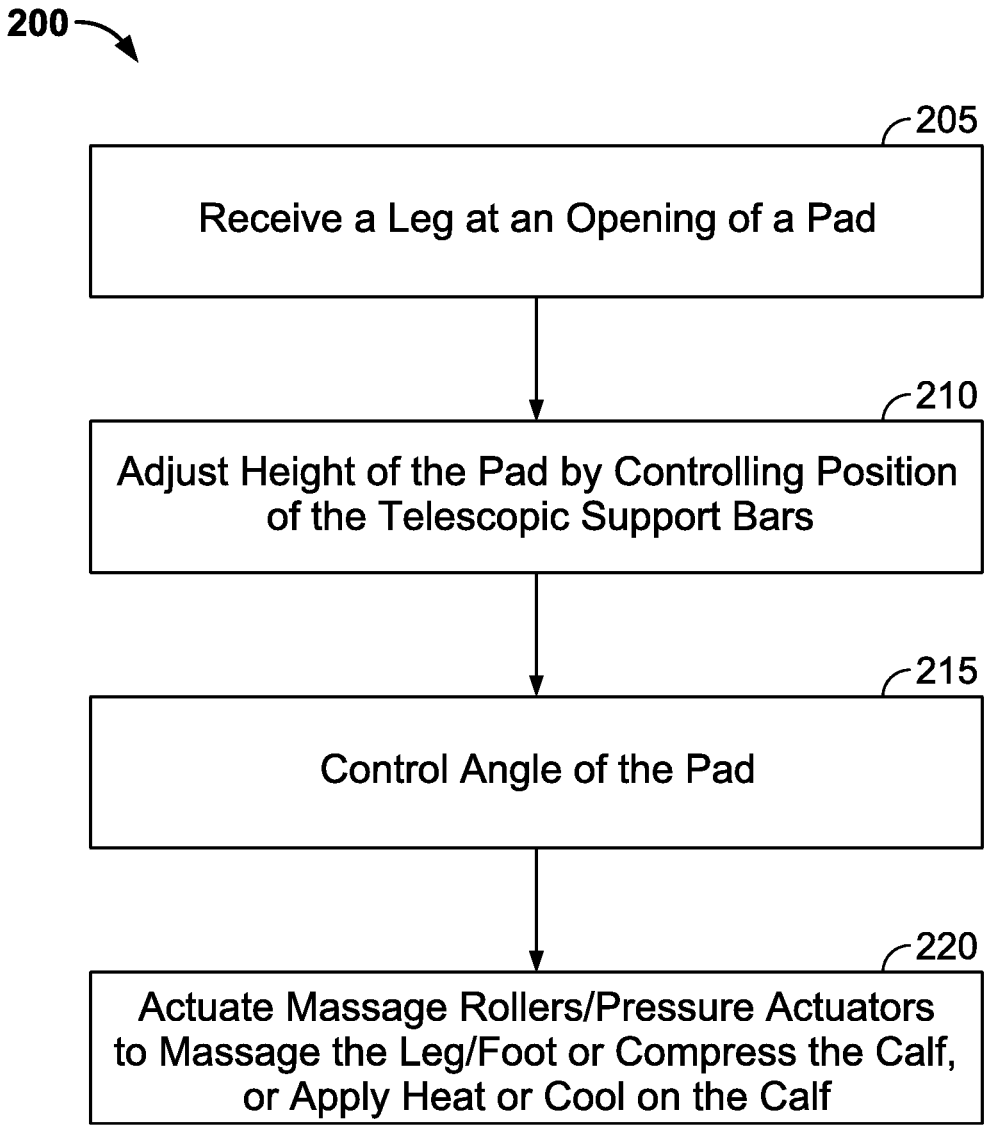
FIG. 6 illustrates a method 200 for providing compression for a limb, in accordance with another embodiment of the present disclosure.

Referring now to FIG. 6, a method 200 for providing compression for a limb is shown, in accordance with an embodiment of the present disclosure. The method 200 may be described in the general context of computer executable instructions or a sequence of steps to be performed for automated checkout. However, the order in which the method 200 is described and is not intended to be construed as a limitation, and any number of the described method blocks can be combined in any order to implement the method 200 or alternate methods. Additionally, individual blocks may be deleted from the method 200 without departing from scope of the disclosure described herein. For ease of explanation, in the embodiments described below, the method 100 may be implemented in the above-described therapeutic apparatus 10.

At step 205, leg or limb of a user is received at the opening 32 of the pad 30.

At step 210, the user may adjust the height of the telescopic support bars 25 in order to adjust the height of the pads 30.

At step 215, the angle of the pads 30 is adjusted using the controllers 70 provided at the housing 15.

At step 220, the pressure actuators 35 are activated to massage the leg/foot or compress the calf or to apply heat or cool on the calf.

Based on the above, it is evident that the therapeutic apparatus can be used for compressing the limb. Further, the therapeutic apparatus can be used to rest the legs of the user and to adjust height at which the user can position the leg in a comfortable position as so to prevent swelling and to reduce pain. In other words, the therapeutic apparatus comprising the telescopic support bars help to adjust height of the telescopic support bars to position the pads at desired height. As such, the therapeutic apparatus can be used for compressing the limb and supporting the legs at desired height. Further, the therapeutic apparatus can be provided with telescopic extendable arms such that the therapeutic apparatus can be placed on uneven surfaces such as bed.

As the user himself can use the controllers to control speed of the motor, adjust the height of the telescopic support bars, rotation of the pads and to control temperature of the pressure actuators, the therapeutic apparatus can be operated by the users or patients themselves without the need of a medical practitioner or caretaker.

Alternatively, the therapeutic apparatus can be communicatively coupled to a remote controller or an electronic device using wired or wireless communication protocols. The therapeutic apparatus can be communicatively coupled to operate the controllers remotely to compress the limbs, to adjust the height of the telescopic support bars, rotate the pads or to control temperature of the pressure actuators. It should be obvious to a person skilled in the art to use known mechanisms to operate the controllers to perform various functions described above.

Further, it should be understood that shape, size and placement of the each components shown in figures are provided for illustrative purpose only and should not be construed in limited sense. A person skilled in the art will appreciate alternate parts and/or mechanisms might be used to implement the embodiments of the present disclosure and such implementations will be within the scope of the present disclosure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A therapeutic apparatus for supporting a limb and compressing the limb, the therapeutic apparatus comprising:

a housing having a bottom, four upstanding sidewalls and an open top defining a container with a cuboid shape, wherein each of said four upstanding sidewalls is rectangular, wherein each of said four upstanding sidewalls has a same height and a same width therebetween defining a cuboid enclosure, said bottom has a rectangular flat shape, at least two telescopic extendable arms provided underneath said bottom, wherein each of said at least two telescopic extendable arms extends parallelly beyond bottom edges of at least two opposite sidewalls of said four upstanding sidewalls, wherein wheels are attached to the bottom corners of said housing;

a plurality of telescopic support bars mounted at said bottom of the housing, wherein said plurality of telescopic support bars are capable of having an adjustable height, wherein each of said plurality of telescopic bars has a rectangular shape, wherein a length of each of said plurality of telescopic bars is greater than a width of each of said plurality of telescopic bars;

a plurality of pads, wherein each of the plurality of pads is mounted to corresponding telescopic support bar of the plurality of telescopic support bars, wherein each of said plurality of pads includes a central portion and two lateral walls, wherein said two lateral walls are inclined to provide a maximum incline that is higher than a height of said central portion;

a plurality of pressure actuators provided at said central portion of each of the plurality of pads, wherein said plurality of pressure actuators are pressure points, wherein said plurality of pressure actuators are configured to apply a pressure on the limb to compress a calf preventing blood clots;

a motor and a transceiver, wherein said motor is configured to actuate said plurality of telescopic support bars to adjust angle or tilt each of said plurality of pads, a remote controller, said remote controller is operated to actuate said motor, said remote controller is removable attached to said housing, wherein said transceiver is capable of receive a signal from said remote controller to actuate said motor; and wherein said housing further includes controllers built in one of said four upstanding sidewalls of said housing, said controllers are operated to actuate said motor to adjust angle or tilt each of said plurality of pads.

2. The therapeutic apparatus of claim 1, wherein each pad is hingedly mounted to each of the telescopic support bars.

3. The therapeutic apparatus of claim 2, wherein the pad is tiltable at its own axis.

4. The therapeutic apparatus of claim 2, wherein the controllers are configured to adjust the height of the telescopic support bars, tilt of the pads and to control speed of the pressure actuators.

5. A therapeutic apparatus for supporting a limb and compressing the limb, the therapeutic apparatus comprising:

a housing having a bottom, four upstanding sidewalls and an open top defining a container with a cuboid shape, wherein each of said four upstanding sidewalls is rectangular, wherein each of said four upstanding sidewalls has a same height and a same width therebetween defining a cuboid enclosure, said bottom has a rectangular flat shape, two telescopic extendable arms provided underneath said bottom, wherein each of said two telescopic extendable arms extends parallelly beyond bottom edges of two opposite sidewalls of said four upstanding sidewalls, said housing is made of metal, said two telescopic extendable arms are made of metal, wherein wheels are attached to bottom corners of said housing;

a plurality of telescopic support bars mounted at said bottom of the housing, said plurality of support bars are made of metal, wherein said plurality of telescopic support bars are capable of having an adjustable height, wherein each of said plurality of telescopic bars has a rectangular shape, wherein a length of each of said plurality of telescopic bars is greater than a width of each of said plurality of telescopic bars;

a plurality of pads, wherein each pad of the plurality of pads is mounted to corresponding telescopic support bar of the plurality of telescopic support bars, wherein the pad is hingedly mounted to the telescopic support bar, and wherein the pad is tiltable at its own axis, wherein each of said plurality of pads includes a central portion and two lateral walls, wherein said lateral walls are inclined to provide a maximum incline that is higher than a height of said central portion;

a plurality of pressure actuators provided at each of the plurality of pads, wherein said plurality of pressure actuators are configured to apply a pressure on the limb to compress a calf preventing blood clots, wherein said plurality of pressure actuators are pressure points; and a motor and a transceiver, wherein said motor is configured to actuate said plurality of telescopic support bars to adjust angle or tilt each of said plurality of pads; and a remote controller and controllers, said remote controller is operated to adjust angle or tilt of said plurality of pads actuate said motor, said remote controller is removable attached to said housing, wherein said transceiver is capable of receive a signal from said remote controller to actuate said motor, wherein said controllers are built in one of said four upstanding sidewalls of said housing, said controllers are operated to adjust the height of said plurality of telescopic support bars.

* * * * *